US009109308B2

(12) United States Patent
Wright

(10) Patent No.: US 9,109,308 B2
(45) Date of Patent: Aug. 18, 2015

(54) LOOM AND METHOD FOR CREATING AN ARTICLE

(71) Applicant: Sheila A. Wright, Bloomfield Hills, MI (US)

(72) Inventor: Sheila A. Wright, Bloomfield Hills, MI (US)

( * ) Notice: Subject to any disclaimer, the term of this patent is extended or adjusted under 35 U.S.C. 154(b) by 0 days.

(21) Appl. No.: 14/341,187

(22) Filed: Jul. 25, 2014

(65) Prior Publication Data

US 2015/0129077 A1 May 14, 2015

Related U.S. Application Data

(60) Provisional application No. 61/939,338, filed on Feb. 13, 2014, provisional application No. 61/902,922, filed on Nov. 12, 2013.

(51) Int. Cl.

| | |
|---|---|
| ***D03D 29/00*** | (2006.01) |
| ***D03D 33/00*** | (2006.01) |
| *D03D 41/00* | (2006.01) |

(52) U.S. Cl.
CPC ..... *D03D 29/00* (2013.01); *D03D 33/00* (2013.01)

(58) Field of Classification Search
CPC ..... D03D 29/00; D03D 41/00; A44C 27/001
See application file for complete search history.

(56) References Cited

U.S. PATENT DOCUMENTS

| | | | | |
|---|---|---|---|---|
| 2,073,993 | A * | 3/1937 | MacPherson | 139/33.5 |
| 2,077,532 | A * | 4/1937 | Rossiter | 139/33 |
| 2,096,659 | A * | 10/1937 | Webster et al. | 139/33 |
| 2,110,822 | A * | 3/1938 | Roberts | 139/33 |
| 2,134,066 | A * | 10/1938 | Van Ness | 66/4 |
| 2,139,879 | A * | 12/1938 | Clark et al. | 139/33 |
| 2,146,991 | A * | 2/1939 | Rowntree et al. | 139/91 |
| 2,150,187 | A * | 3/1939 | Raba et al. | 139/33 |
| 2,159,265 | A * | 5/1939 | Gash | 139/34 |
| 2,166,415 | A * | 7/1939 | Lervad | 139/33 |
| 2,166,668 | A * | 7/1939 | Webster et al. | 139/33 |
| 2,186,692 | A * | 1/1940 | Boyer et al. | 139/34 |
| 2,190,813 | A * | 2/1940 | Walker | 28/151 |
| 2,198,624 | A * | 4/1940 | Kimson | 139/33 |
| 2,199,515 | A * | 5/1940 | Woods | 139/34 |
| 2,224,563 | A * | 12/1940 | Clark | 139/33 |
| 2,226,012 | A * | 12/1940 | Owen et al. | 139/33 |
| 2,228,761 | A | 1/1941 | Groetschel | |
| 2,241,199 | A * | 5/1941 | Hines et al. | 139/33 |
| 2,253,329 | A * | 8/1941 | Gallinger | 139/33 |
| 2,257,455 | A * | 9/1941 | Clark | 139/33 |
| 2,274,326 | A * | 2/1942 | Gallinger | 139/33 |

(Continued)

FOREIGN PATENT DOCUMENTS

| | | |
|---|---|---|
| DE | 8706526 U1 | 2/1988 |
| EP | 0113483 A2 | 7/1984 |

OTHER PUBLICATIONS

European Search Report, dated Feb. 5, 2015, Application No. 14189830.4.

*Primary Examiner* — Bobby Muromoto, Jr.
(74) *Attorney, Agent, or Firm* — The Dobrusin Law Firm, P.C.

(57) ABSTRACT

A device having a housing structure, a plurality of pegs in communication with the housing and the plurality of pegs extending at an angle relative to a plane so that the plane extends between at least a plurality of pegs and wherein the angle of plurality of pegs are in different directions so that the at least a portion of plurality of pegs are movable from a first side of the plane to the second side of the plane.

17 Claims, 11 Drawing Sheets

(56) References Cited

U.S. PATENT DOCUMENTS

| | | | | | |
|---|---|---|---|---|---|
| 2,285,385 | A | | 6/1942 | Astley | |
| 2,346,541 | A | * | 4/1944 | Owen et al. | 139/33 |
| 2,350,167 | A | * | 5/1944 | Jones et al. | 139/29 |
| 2,380,233 | A | * | 7/1945 | Greenwood | 139/33 |
| 2,382,048 | A | * | 8/1945 | Fox et al. | 139/34 |
| 2,424,880 | A | * | 7/1947 | Dillon | 139/33 |
| 2,427,093 | A | * | 9/1947 | Eckert | 28/152 |
| 2,437,716 | A | * | 3/1948 | Tiefenthal | 139/33 |
| 2,444,162 | A | | 6/1948 | Havice | |
| 2,463,365 | A | * | 3/1949 | Epstein | 139/34 |
| 2,563,510 | A | * | 8/1951 | Bellin | 139/1 R |
| 2,566,657 | A | * | 9/1951 | Epstein | 139/34 |
| 2,601,715 | A | * | 7/1952 | Simonds | 28/152 |
| 2,756,780 | A | * | 7/1956 | Epstein | 139/30 |
| 2,780,854 | A | * | 2/1957 | Dritz | 28/152 |
| 2,786,490 | A | * | 3/1957 | Epstein | 139/33 |
| 2,797,710 | A | * | 7/1957 | Bintz et al. | 139/33 |
| 2,817,366 | A | * | 12/1957 | Sakano | 139/29 |
| 3,032,071 | A | * | 5/1962 | Kokonoe | 139/33 |
| 3,106,228 | A | * | 10/1963 | Nicolet | 139/33 |
| 3,347,281 | A | * | 10/1967 | Stars | 139/29 |
| 3,665,971 | A | * | 5/1972 | Ileks | 139/33 |
| 3,688,357 | A | * | 9/1972 | Nielsen et al. | 289/17 |
| 3,708,839 | A | * | 1/1973 | Prince | 28/150 |
| 3,724,041 | A | * | 4/1973 | Cleverley | 28/149 |
| 3,738,395 | A | * | 6/1973 | Stars | 139/29 |
| 3,739,437 | A | * | 6/1973 | Alberici et al. | 28/151 |
| 3,776,280 | A | * | 12/1973 | Kliot | 139/33 |
| 3,879,823 | A | * | 4/1975 | Lamb | 28/147 |
| 3,885,597 | A | * | 5/1975 | Hines | 139/29 |
| 3,971,417 | A | * | 7/1976 | Gentil | 139/34 |
| 3,996,969 | A | * | 12/1976 | McCullough et al. | 139/29 |
| 4,046,172 | A | * | 9/1977 | Russell | 139/33 |
| 4,072,173 | A | * | 2/1978 | Markowitz et al. | 139/34 |
| 4,074,726 | A | * | 2/1978 | Harris | 139/29 |
| 4,077,436 | A | * | 3/1978 | Kliot | 139/34 |
| 4,103,715 | A | * | 8/1978 | Harris | 139/33 |
| 4,160,467 | A | * | 7/1979 | Woodruff | 139/33 |
| 4,181,158 | A | * | 1/1980 | Kidd | 139/33 |
| 4,564,049 | A | * | 1/1986 | Allihn | 139/33 |
| 4,741,366 | A | * | 5/1988 | Yamotogi | 139/34 |
| 4,832,085 | A | * | 5/1989 | Northrup | 139/34 |
| 5,146,659 | A | * | 9/1992 | Spriggs et al. | 28/152 |
| 5,231,742 | A | * | 8/1993 | MacBain | 28/151 |
| 5,413,150 | A | * | 5/1995 | Townsend | 139/34 |
| 6,065,504 | A | * | 5/2000 | Sidore | 139/29 |
| 6,834,682 | B2 | * | 12/2004 | Jenner et al. | 139/29 |
| 7,320,343 | B2 | | 1/2008 | Speich | |
| 7,658,210 | B1 | * | 2/2010 | Nyce | 139/29 |
| 8,234,850 | B1 | * | 8/2012 | Wright | 57/10 |
| 8,234,851 | B2 | * | 8/2012 | Wright | 57/10 |
| 8,397,478 | B2 | * | 3/2013 | Wright | 57/11 |
| 8,528,309 | B2 | * | 9/2013 | Wright | 57/10 |
| 8,919,090 | B2 | * | 12/2014 | Wright | 57/10 |
| 2007/0270010 | A1 | * | 11/2007 | Walter | 439/259 |
| 2008/0223083 | A1 | * | 9/2008 | Gustin | 66/1 A |
| 2009/0123095 | A1 | * | 5/2009 | Welch et al. | 383/117 |
| 2009/0293982 | A1 | * | 12/2009 | Skaflestad | 139/34 |
| 2010/0218840 | A1 | * | 9/2010 | Crorey | 139/29 |
| 2011/0259465 | A1 | * | 10/2011 | Schaub | 139/29 |
| 2012/0174405 | A1 | * | 7/2012 | Wright | 29/896.411 |
| 2012/0267469 | A1 | * | 10/2012 | Wright | 242/446 |
| 2013/0199149 | A1 | * | 8/2013 | Wright | 57/10 |
| 2013/0291994 | A1 | * | 11/2013 | Wijerama et al. | 139/29 |
| 2013/0327878 | A1 | * | 12/2013 | Wright | 242/430 |
| 2014/0166150 | A1 | * | 6/2014 | Teramoto et al. | 139/29 |
| 2014/0373966 | A1 | * | 12/2014 | Nedry et al. | 139/29 |
| 2015/0101305 | A1 | * | 4/2015 | Wright | 57/11 |

* cited by examiner

LOOM AND METHOD FOR CREATING AN ARTICLE

FIELD

The present teachings relate to a device for weaving one or more pieces of flexible mediums together to form an article.

BACKGROUND

Looms may be used to weave one or more pieces of material together to form articles such as a scarf, sock, or rug. Existing weaving looms and methods for creating woven articles are either complex to set up, provide a limited number of items that can be produced, or are simple to use but require repetitive, redundant motion, and are relatively time consuming and monotonous, especially for children. One example of a loom that may be used is a peg loom where a flexible medium is manually woven back and forth around pegs from a first end to a second end. The flexible medium is then woven around pegs in an alternating fashion from the second end to the first end. This process is repeated multiple times until a desired length article is created. Further, if a long article is desired (e.g., 3 feet or longer) it may take hours to weave the flexible medium around the pegs so that an article is formed. Additionally, the width of the article may be limited to the width of the loom, thus, the user may have to settle with an article that has a width that is less than desired or manually connect 1 or more articles together after the articles are removed from the loom.

A potholder loom is a type of loom that is commonly used by children. This loom has a fixed shape (e.g., square) and pegs are aligned around the loom (i.e., the warp) and children weave a medium around the pegs typically using a hand tool so that an article is created. The weaving pattern for these looms may be complex and forming an article may be time consuming such that children may lose interest before completing an article or may not be able to form more complex articles. The articles formed may be limited in size to the size of the loom or may be limited in shape to a shape such as a square. Two examples may be found in U.S. Pat. No. 2,427,093 and Patent Application Publication No. 2007/0270010 the teachings of which are expressly incorporated by reference herein for all purposes.

Peg weaving looms are a type of loom with a generally fixed shape and one or more pieces of flexible medium are woven around pegs and pieces of flexible medium that are connected to pegs to create an article. The weaving patterns can be complex, especially for children, and it may be time consuming to create an article. An example of a peg weaving loom may be found in U.S. Pat. No. 3,688,357 the teachings of which are expressly incorporated by reference herein for all purposes.

Another example is a heddle loom, which has a plurality of warp mediums extending a length of the loom or longer. The longer warps may be wrapped around some rods so that another device is passed through and woven around the plurality of warp mediums spanning the length of the loom. This process is repeated until an article of a desired length is created. The set-up of a heddle loom can be complex and time consuming, especially for children, and weaving the mediums through the mediums spanning the length of the loom may be challenging for children and they may lose interest before an article is complete. An example of a heddle loom may be found in U.S. Pat. No. 2,077,532 the teachings of which are all incorporated by reference herein for all purposes.

Examples of other such devices are disclosed in U.S. Pat. Nos. 2,146,990; 3,688,357; 4,074,726; and 4,103,715 all of which are expressly incorporated herein by reference for all purposes. Thus, there is a need for a device that simplifies creation of article so that young children may quickly and easily make articles that may be varied is size, shape, length, width, or a combination thereof. There is also a need for a simple device that increases the speed of creating an article without affecting the user's sense of input and creative direction, while optimizing the flexibility for generating different types of articles, designs, configurations, color combinations, or a combination thereof. There is a need for a durable device that has a high level of lateral stability so that the device can withstand dropping, bumping, and continual use without moving parts becoming disengaged and requiring repair and/or realignment. It would be attractive to have a process that produces or aids in the production of unique articles.

SUMMARY

One possible embodiment of the present teachings is a device comprising: (a) housing structure: (b) a plurality of pegs in communication with the housing structure; wherein at least a portion of the plurality of pegs extend at an angle relative to a plane so that the extends between at least a portion of the plurality of pegs, and wherein the angle of the plurality of pegs are in different directions so that the at least a portion of the plurality of pegs are movable from a first side of the plane to the second side of the plane.

A possible embodiment of the present teachings is a device comprising: (a) housing structure; (b) a plurality of pegs in communication with the housing structure; and (c) a plurality of weft guides, each of the plurality of pegs being in communication with one of the plurality of weft guides; wherein the plurality of weft guides extend at an angle relative to the plurality of pegs, and the angle of the plurality of weft guides extend in alternating directions.

One possible embodiment of the present teachings is a method comprising: (a) obtaining the device of any of the preceding claims (b) connecting one or more flexible mediums to each of the plurality of pegs so that the one or more flexible mediums extend from and/or along each of the plurality of pegs; (c) extending one or more flexible mediums along a top of the plurality of pegs so that the one or more flexible mediums alternatingly extend around the plurality of pegs; and (d) rotating the plurality of pegs so that extending the one or more flexible mediums along a top of the plurality of pegs alternatingly extends the one or more flexible mediums along an opposing side of each of the plurality of pegs in an alternating manner.

One unique aspect of the present teachings envisions: a method comprising: (a) connecting one or more warp flexible mediums to each of a plurality of weft guides that are each in communication with a peg; (b) aligning each of the plurality of weft guides so that each of the plurality of weft guides extend away from a centerline in alternating directions; (c) extending one or more weft flexible mediums along the centerline so that the weft guides align the one or more weft flexible mediums on alternating sides of the plurality of pegs; and (d) rotating the plurality of weft guides and associated pegs so that the plurality of weft guides extend on an opposing side of a centerline.

The present teachings provide a device that simplifies creation of article so that young children may quickly and easily make articles that may be varied is size, shape, length, width, or a combination thereof. The present teachings provide an elegantly simple device that increases the speed of creating an article without affecting the user's sense of input and creative direction, while optimizing the flexibility for generating different types of articles, designs, configurations, color combinations, or a combination thereof. The present teachings provide a durable device that has a high level of lateral stability so that the device can withstand dropping, bumping, and continual use without moving parts becoming disengaged and requiring repair and/or realignment. The present teachings provide a process that produces or aids in the production of unique articles.

DETAILED DESCRIPTION

Figure 1:
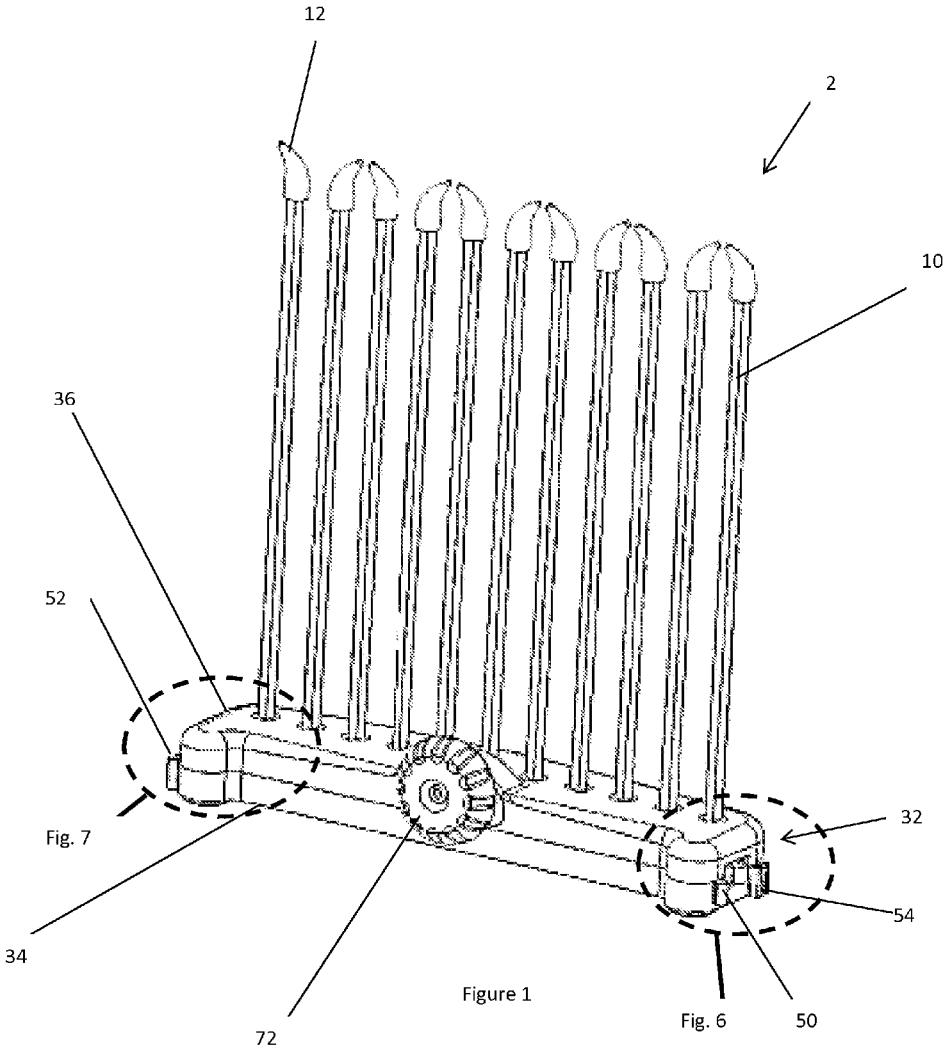
FIG. 1 illustrates a perspective view of one loom.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the teachings. The scope of the teachings should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

The present teachings claim priority to U.S. Patent Application Publication Nos. 61/902,922, filed on Nov. 12, 2013 and 61/939,338, filed on Feb. 13, 2014, both of which are incorporated by reference herein in their entirety for all purposes. The present teachings are predicated upon providing an improved device for creating articles. More specifically, the improved device as discussed herein is a loom for creating articles. The loom as discussed herein may be any device that may assist in creating articles that include a section that is partially and/or fully woven together. The present teachings include a device and method that assists young children in creating unique articles such as blankets; rugs; scarves; throws; purses; bags; socks; clothing; hats; sweaters; shawls; cases; mittens; skirts; pillows; placemats; decorative articles; drapes; bracelets, necklaces, skirts, phone cases, tablet cases, wallets, any type of article that may be made by weaving, knitting, crocheting; the like, or a combination thereof quickly and efficiently so that the user, children, or both do not become frustrated and/or lose attention. The present teachings further teach a device that withstands lateral forces and especially lateral displacement of parts by actions such as dropping, banging, hitting, and normal use conditions.

The present teachings relate to a device for creating unique customized articles as discussed herein, preferably clothing such as scarves, socks, or sweaters, or decorative articles. The device includes a housing structure with a first end region and a second end region spaced apart from the first end region. The body portion may include an external shell and an internal component. The external shell may substantially surround the internal component. For example, the internal component may have a shape substantially similar to that of the external shell and may enter the external shell and form a base of the body portion that the external shell rests upon. The internal component may have substantially the same components described herein for the external shell, the body portion, or both. For example, the internal component may be an actuation device that moves within the external shell. The external shell and the internal component when connected may form a body portion. Preferably, the internal component is located entirely within the external shell. A portion of the internal component may extend out of one or more locations of the external shell. For example, the ends of the actuation device may extend out of each end of the housing structure so that one or both ends of the actuation device may be connected to an actuation device of an adjacent device. The external shell may be made of two or more pieces that are connected together. The external shell may be transparent so that the internal components may be visible during use. The external shell and the internal component, the two or more pieces of the external shell, or both may be connected using a fastener (e.g., snaps, locking tabs, screws, glue, a friction fit, an interference fit, or a combination thereof).

The device may include one or more hinges. The device may include a plurality of hinges. The device may include quick release parts so that the device may be taken apart quickly and put back together quickly. The device may fold so that it may be stored, transported, moved, changed into a different shape and/or configuration, or a combination thereof easily. The device may be biased about the one or more hinges so that the shape of the device may be changed. The device may be straight, curved, arcuate, "S" shaped, "C" shaped, "U" shaped, may include linear portions and curved portions, or a combination thereof. The device may be arcuate shaped so that multiple devices may be connected together to form a shape. The device may include hinged portions so that a size of a shape may be varied (e.g., a circle with a larger diameter or a smaller diameter may be formed by adjusting the hinge). The device may include an attachable handle. The device may include an integral handle. For example, a piece of the device may be functionally used as a handle in addition to being used as the body of the device. The device may include a cover, a carrying case, the device may be the carrying case, one or more storage areas, one or more drawers, one or more compartments, or a combination thereof.

The device may include one or more gears. The device may include gears at the first end, the second end, in a central portion, substantially along a length of the device, or a combination thereof. The one or more gears may function so that the bias device may move the one or more gears and the one or more of the pegs, the one or more weft guides, or both individually and/or in unison. The one or more gears may directly rotate the pegs. The one or more gears may be connected a rod that extends through a center of each of the pegs and rotates the weft guides. The one or more gears may be free of intermeshing (i.e., the gears may not be connected together). The gears of one device may be inter-meshed, all in communication with one or more actuation gears or preferably the same actuation gear, or both. For example, there may be a plurality of gears that are each in communication with a peg so that when the bias device is actuated an actuation device moves so that the plurality of gears are all moved by actuation gears of the actuation device. A plurality of gears may be inter-meshed. The gears may be located in and/or between structures so that the gears are maintained in contact, alignment, a driving relationship, or a combination thereof. The gears may be located in a straight line, in an arcuate shape, an "S" shape, a "C" shape, a "U" shape, an arcuate line, a circle, or a combination thereof. The gears may be connected. The gears may be indirectly in communication through an actuation device. The gears may be vertically stacked. The gears may be off-set. For example, the centers of the gears may not be vertically aligned. The gears may be the same size. The gears may be different sizes. The gears may include step down gearing. For example, the gear connected to the bias device (e.g., a rotation wheel) that may be larger than the gear attached to the holder so that one rotation of the bias device rotates the plurality of pegs a predetermined distance (e.g., 180 degrees). The gears may be solid (i.e. include teeth around the entire circumference). The gears may include a portion free of teeth (i.e. a portion of one or more gear may not include teeth). The gears may have a portion that is free of teeth so that the gears may be assembled in only one configuration. The gears may have teeth in about 340 degrees or less, about 320 degrees or less, about 300 degrees or less, or even about 270 degrees or less of the way around an outer circumference of the gear (i.e., 360 degrees). The gears may have teeth in about 180 degrees or more, about 225 degrees or more, or about 260 degrees or more of the way around an outer circumference of the gear. The gears may be stacked one on top of another around a base of a peg, inside of a peg or both. The pegs, the gears, the weft guide, or both may be moved so that a different portion of the stacked gears rotate the pegs, the weft guide, or both. The stacked gears may be a column of 2 or more, 3 or more, 4 or more, or even 5 or more high. Each of the columns of stacked gears may rotate the pegs, the weft guides, or both in a different fashion. The column of stacked gears may be selected to create patterns in an article. The each of the gears in the column of stacked gears may have a different tooth size, distance between teeth, length of teeth, or a combination thereof. Each of the teeth in a column may correspond to a shape or configuration of teeth on the actuation device. For example, the gears may rotate the pegs, the weft guide, or both a predetermined angle so that a desired pattern is formed in an article. The device may be free of gears (i.e. the holder is directly attached to the rotation device and the holders are directly driven by the rotation device). The device may be driven by a belt, a chain driven, gear driven, a direct drive, indirectly driven, screw driven, any type of drive mechanism that may turn the holders, or a combination thereof. The device may be driven by a bias device.

The bias device may function to rotate the one or more pegs, rotate the one or more weft guides, rotate the one or more rotation devices, move an actuation device, rotate the one or more gears that in turn rotate the one or more pegs and the one or more weft guides, alternate angles of the pegs, alternate angles of the weft guides, laterally move the pegs, or a combination thereof. The bias device may move all or a portion of the pegs, the weft guides, or both from a first side of a plane to a second side of a plane (e.g., a vertical plane). The bias device may be a rotation wheel, a lever, a switch, a push button connected to a motor, a foot petal connected to a motor, motor driven, cam driven, belt driven, link driven, pump driven, hydraulically driven, chain drive, axle driven, worm gear driven, battery operated, free of batteries, plugged into an outlet to operate, solar powered, a wind up device, a foot petal, manually operated, mechanically operated, or a combination thereof. The bias device may move in the same direction as the movement of the rotation devices, the one or more actuation devices, the one or more pegs, the one or more weft guides, or a combination thereof. The bias device may move in an opposing direction as movement of the rotation devices, the one or more pegs, the one or more weft guides, the one or more actuation devices, or a combination thereof. The bias device upon being biased may rotate the pegs, laterally move the pegs (e.g., the pegs may be moved so that the pegs are out of alignment), change the angle of the pegs, move the pegs up and down, move the pegs diagonally (e.g., towards and/or away from each other), longitudinally (e.g., so that the spacing between the pegs is increased or decreases), or a combination thereof. The one or more pegs may each have 1 or more, 2 or more, 3 or more, 4 or more, 5 or more, or even 6 or more degrees of freedom. The bias device may be operated with one hand. The bias device may be locked into a position, may be free moving, or both. The bias device may be connected to the body portion, be integrally connected to the body portion, extend from the body portion, or a combination thereof.

The body portion may be free of legs (e.g. the body portion may rest directly on a platform, table, a piece of furniture, the floor, a lap, the like, or a combination thereof). The device may be hand held and the body portion may include a holding portion. Preferably, the body portion may include a base portion. For example, the base portion may function to contact a surface discussed herein and maintain the position of the device. The body portion may include one or more storage drawers. The body portion may be free of storage drawers. The storage drawers may extend from any part of the device so that one or more secondary mediums, flexible mediums, device components, accessories, or a combination thereof may be stored in the one or more storage drawers. The body portion may include legs. The body portion may include one or more legs. Preferably, the body portion includes a plurality of legs (e.g. 2 legs, 4 legs, or more). The legs may be a standard height. The legs may have an adjustable height. The legs may be extendable so that the legs may be used to stabilize the device on uneven surfaces. The legs and/or bottom of the body may include a non-slip surface (e.g. a coating, film, layer, the like, or a combination thereof). The legs and/or bottom of the body may use any non-slip surface that prevents the device from moving during use. For example, the bottom of the legs and/or bottom of the body may include a piece of rubber, a polymeric material, a rough material, the like, or a combination thereof. The base portion may be weighted. The base portion may be free of added weight. The base may include a hole so that weight (e.g. sand, water, the like, or a combination thereof) may be added by the user. The base portion may include any attachment device that functions to hold the device in place. The attachment device may permanently connect, temporarily connect, removably connect, or a combination thereof the device to a user platform such as a table, furniture, a platform, the like, or a combination thereof. The base portion may include a suction cup device for attachment to a surface. The base portion may include a clamp for attachment to a table or another platform.

The device (i.e., actuation device, housing structures, pegs, weft guides, rotation devices, translation mechanisms, bias devices, any other devices disclosed herein, or a combination thereof) may be made of any material so that the device may be used to make articles that are taught herein. The device may be made of a flexible material. Preferably, the device may be made of a rigid material. The device may be made of a polymer. The device may be made of a plastic material. The device may be made entirely of plastic. Preferably, the device may be made of Acrylonitrile Butadiene Styrene (ABS), polypropylene, nylon, delrin, metal, wood, or a combination thereof. The device may be made of metal and/or include metal. Preferably, the body portion may be made of ABS or polypropylene. Preferably, the gears may be made of nylon, delrin, polypropylene, or a combination thereof. The device may be free of metal components. The device may be made of a washable material. The device may be made of a material that may be conformed to an individual user's preferences. For example, the device may be permanently and/or temporarily individualized by a user (e.g., painted, colored, drawn on, stained, marked, or a combination thereof). For example, the material of the device may be permanently marked by one type of marking device and temporarily marked by a different marking device.

The actuation device may function to actuate one or more of the pegs, one or more of the weft guides, or both. The actuation device may function to actuate all of the plurality of pegs, all of the plurality of weft guides, or both. The actuation device may substantially extend from a first end region of the housing to a second end region of the housing so that any pegs, weft guides, or both are actuated upon movement of the actuation device. The actuation device may be longitudinally movable and as the actuation device moves along the longitudinal axis the gears may be rotated. The actuation device may include one or more actuation gears.

The one or more actuation gears may function to move the pegs, gears, weft guides, or a combination thereof. The actuation gears may extend along the length of the actuation device. The actuation gears may continuously extend along the length of the actuation device. The actuation gears may cover intermittent portions of the actuation device. The actuation gears may cause rotation of the pegs, the weft guides, or both. The actuation gears may cause tilting of the pegs, angling of the pegs, pivoting of the pegs, movement of the pegs from a first side to a second side, or a combination thereof. The actuation gears may cause the pegs to tilt, angle, curve, bend, or a combination thereof at some point along a longitudinal axis of the pegs. The actuation device may include one or more rows of actuation gears (i.e., teeth). The one or more rows of actuation gears may be located on a single plane. The one or more rows of actuation gears may be located on 2 or more, 3 or more, 4 or more, or even 5 or more planes. Each row of actuation gears in a plane may have different sizes shapes, patterns, configurations spacing, or a combination thereof so that as the teeth on the actuation device contact the gears on the pegs, the pegs and/or weft guides are rotated at a different rate, a different distance, to a different configuration, or a combination thereof so that different patterns may be formed. For example, one peg may be rotated 180 degrees and the adjacent pegs may not rotate so that the flexible medium is fed on the same side of three adjacent pegs and then during a subsequent rotation all three may rotate 180 degrees. The gears may include multiple planes of teeth so that when the actuation device and/or gears are moved along a vertical axis a predetermined number of gears are rotated to create a pattern. The actuation devices may be swappable so that different patterns are created. For example, based upon a desired design in the final article an actuation device may be selected with a configuration in the rows of teeth. Actuation device may be multiple pieces so that a piece of the action device may be changed to affect movement a portion of the pegs, the weft guides, or both (e.g., the first quarter may rotate at a different rate than a middle section or the middle section may rotate at a different rate than the end section). The teeth may be movable individually so that some pegs and/or weft guides are moved and some pegs and/or weft guides are not (e.g., the actuation gears may be extended, may be retracted, an angle of the teeth may be varied, the length of the actuation gears may be varied, or a combination thereof). The actuation gears may be engageable or disengageable so that some pegs, some weft guides, or both don't rotate. The actuation device may include rotation gears.

The rotation gears may function to move the actuation device so that the actuation gears move the pegs, the weft guides, or both. The rotation gears may function to laterally move the actuation device, longitudinally move the actuation device, diagonally move the actuation device, or a combination thereof so that the pegs, weft guides, or both are moved. The rotation gears may extend along an adjacent surface of the actuation device relative to the actuation gears. The rotation device may be a plurality of teeth that allow the actuation device to be biased. The rotation gears may be located on an opposite side as the actuation gears, on a side 90 degrees from the actuation gears, or both. The rotation gears may be located at any location along the actuation device so that the actuation device is moved, moves the pegs and/or weft guides, or both. The rotation gears may be located in a central region. The rotation gears may extend the length of the actuation device. The rotation gears may be substantially the same length as a total length of the gaps that are located on both ends of the actuation device. The rotation gears may be sufficiently long so that the pegs, the weft guides, or both may be rotated about 90 degrees or more, about 180 degrees or more, about 270 degrees or more. The rotation gears may be configured so that the actuation device and associated pegs, weft guides, or both are rotated in manner to create a predetermined pattern in an article upon movement of the actuation device. The rotation gears may be in communication with a translation device that translates the actuation device. The device may have a computer that controls movements of the pegs.

The computer may function to control rotation of one or more pegs, one or more weft guides, or both. Preferably, the computer controls rotation of each peg and/or weft guide individually. The computer may include one or more and preferably a plurality of designs. Each design may have a rotation configuration for the pegs and/or weft guides so that the pegs and/or weft guides are rotated and a flexible medium is extended along the axis and a completed article includes a selected design. The selected design may be any shape, configuration, patter, or a combination thereof. The selected design may be a circle, square, diamond, stripes, diagonal lines, vertical lines, horizontal lines, an animal, a shape, or a combination thereof. The computer may control one or more motors, a plurality of motors, or both that control the one or more pegs, one or more weft guides, or both. The computer may allow a user to create a customized design. The computer may allow an individual to customize the article created.

The device may be further customized by individuals. For example, the device may have portions that are magnetic so that the user may customize the device by adding magnets. The device may include a portion with a hook and loop fastener so that items may be attached to the device. The device may include portions that are removable so that a different color, design, style, or a combination thereof may be added to the device. The device may be made of a material that is washable so that a design may be added to the device and subsequently removed. The housing structure of the device may include one or more parts that when connected together form a base of the device, a body portion, or both.

The housing structure may include one or more portions. The housing structure may function to fully and/or partially enclose one or more moving parts, form a connection for one or more pegs, create a foundation and/or platform for the device, or a combination thereof. The housing structure may include one or more attachment sites, connection features, or both so that two or more housing structures may be connected together. The housing structure may be jointed so that the shape of the housing structure may be changed. For example, the housing structure may be jointed so that the housing structure may be changed from being substantially linear to a half circle so that if two or more housing structures are connected a complete circle is formed. The housing structure may have a fixed length. The housing may have a variable length. The housing may be expandable. For example, the housing may include one or more segments that may be nested within another segment and when a length increase is desired the nested segments may be extended outward and more pegs added so that a length of an article is increased. The housing may have an accordion expansion device. The housing may be transparent so that moving components of the device are visible. The housing may be an open platform so that the components of the device are visible. The housing may connect directly to the pegs and the housing may be free of any moving parts. The housing may retain the pegs so that the pegs may be bent, pivoted, or both. The housing may retain the pegs so that an alternating guide may be used to apply one or more wefts, one or more flexible mediums, or both around the pegs. The housing structure may include a support housing and a peg housing.

The support housing may function to provide support to the device, one or more of the plurality of pegs, one or more of the plurality of rotation devices, one or more actuation devices, or a combination thereof. The support housing may be part of the device that is in contact with a surface. The support housing may be in communication with a peg housing.

The peg housing may function to support one or more pegs, one or more rotation devices, one or more guides, one or more warp attach devices, one or more actuation devices, or a combination thereof. The peg housing may include a plurality of rotation device holes that one or more pegs, one or more rotation devices, or both extend through. The peg housing, the support housing, or both may substantially surround all or a portion of the one or more pegs, the one or more rotation devices, or both so that the one or more pegs are rotatable about an axis.

The one or more rotation devices may function to rotate about an axis, rotate one or more pegs, one or more guides, or both about an axis, or both. The one or more rotation devices may function as a bearing surface, as a pivot point, or both. The one or more rotation devices may include one or more structures that assist in rotating the one or more rotation devices, the one or more pegs, the one or more guides, the one or more weft guides, or a combination thereof. The one or more rotation devices may include a drive portion such as a geared portion, a toothed portion, a belt driven portion, a bias portion, or a combination thereof so that the drive portion assists in rotating the one or more rotation device and/or pegs about an axis, a pivot point, or both.

The one or more pegs may function to elevate one or more warp flexible mediums, one or more weft flexible mediums, or both. The one or more pegs may function to create a plurality of structures to extend flexible mediums around (e.g., the flexible mediums are woven around the pegs, extend at least partially around the pegs, or both). The one or more pegs function to create an operating space were woven flexible medium is stored before moving woven flexible medium off of the pegs and onto only the warp flexible mediums. The one or more pegs may function to assist in moving one or more warp flexible mediums through one or more weft flexible mediums. The one or more pegs may be a plurality of pegs. The one or more pegs may be removable from the housing structure, the rotation device, the weft guides, or a combination thereof. The one or more pegs may form a surface that one or more weft flexible mediums may be woven around, extended along one or both sides, intertwined with, or a combination thereof. The one or more pegs may vertically extend from the housing structure. The one or more pegs may extend on a side of a plane, along a plane, or a combination of both. For example, all or a portion of the one or more pegs may extend on either a first side of a plane or a second side of a plane. The plane may extend along a centerline of the housing. The plane may extend along a centerline between the pegs, the weft guides, or both. The plane may extend along a midpoint of the housing that bisects the housing. The plane may extend at an angle relative to the housing. For example, the plane may extend at an angle of about 5 degrees or more, 10 degrees or more, or even about 15 degrees or more relative to vertical. The plane may extend at an angle of about 45 degrees or less, 30 degrees or less, or 25 degrees or less. Preferably, the plane is a vertical plane (i.e., extends in the direction of gravity). The one or more pegs may extend at an angle (i.e., be tilted) from the housing structure. The angle of the pegs may alternate as the pegs extend along the housing structure. The plurality of pegs may be curved, shaped (e.g. with a contour, a shape angle (e.g. bend at a 45 degree angle)), configured to curve, or a combination thereof. The angle of the pegs may be relative to a plane, a vertical plane, or both. The angle may be about ±15 degrees or less, about ±10 degrees or less, or about ±5 degrees or less. For example, the one or more odd pegs may extend at a positive angle (e.g., about 5 degrees or more) relative to a plane (e.g., a vertical plane) and the even pegs may extend at a negative angle (e.g. about −5 degrees or less) relative to plane (e.g., a vertical plane). The angle of the pegs may be alternated after a weft flexible medium is applied along the length of the device, is applied along the pegs, is applied about the pegs, or a combination thereof. The one or more pegs may be static. The one or more pegs may be static and the weft guide of each peg may be rotatable about the peg. The one or more pegs may be spring loaded, lengthened, telescoping, extendable so that the pegs may provide tension on the warp flexible mediums, extended so that the length of the article may be increased, may include a tensioning member, may include a bias member, or a combination thereof. One or more pegs may be connected together to lengthen the pegs. For example, a peg may be removed from the rotation device and another peg placed between the rotation device and the first peg, the weft guide may be removed and another peg placed between the first peg and the weft guide, or both. The one or more pegs may all have a standard length. The length of the one or more pegs may vary along the device. The length of the one or more pegs may alternate in height. For example, one may be tall and the next may be shorter and so on. Each of the one or more pegs may be a predetermined distance apart. The predetermined distance may be a sufficient distance so that a desired article may be formed. The predetermined distance may be about 2 mm or more, about 4 mm or more, about 6 mm or more, or about 8 mm or more. The predetermined distance may be about 50 mm or less, about 25 mm or less, about 20 mm or less, or about 15 mm or less (e.g., about 12 mm) and may vary by about ±10 mm or less, or about ±5 mm or less. The predetermined distance may be the same between the first and last peg when two or more devices are connected together. For example, if the pegs in one loom are about 12 mm apart and a second loom is added the two closest pegs may be about 12 mm apart (although this distance may vary by about ±5 mm) so that a final article does not have an appearance of multiple looms being used. The predetermined distance may be varied by removing pegs and/or adding pegs. For example, every other peg may be removed so that the distance between pegs is doubled. In another example, every third peg may be removed so that there are large spaces between warp flexible mediums in some locations versus other locations. Smaller articles may be formed by removing pegs. For example, half of the pegs may be removed and an article using only half of the pegs may be used to create an article. The distance between the pegs may be customizable. Each of the pegs may be movable laterally, longitudinally, diagonally, or a combination thereof movable within the device, the housing, or both. Each of the pegs may be movable relative to each other so that distances between the pegs are varied along the length of the device. The pegs may slide within a track that is located within the housing. Each peg may include its own track and be movable within the track.

The one or more pegs may be and or include a portion that is round, square, triangular, pentagonal, symmetrical, asymmetrical, "D" shaped, a geometric shape, or a combination thereof. The one or more pegs have a cross-sectional length (e.g., diameter). The cross-sectional length may vary along the length of each peg. The cross-sectional length of the pegs may vary from peg to peg. The cross-sectional length of each peg may be geometric, irregular, symmetrical, asymmetrical, larger on a first side than a second side, or a combination thereof. The one or more pegs may include an axis, may be rotated about an axis (e.g., a rotational axis), may have an axis that extends through the one or more pegs (e.g., a longitudinal axis), or a combination thereof. The one or more pegs may be rotated about their longitudinal axis, the one or more pegs may have a static portion and a rotatable portion. For example, a top half may be rotated by the bias device and the bottom half may remain stationary. The pegs and/or warp guides may be rotated at a base, along the length, at the top, or a combination thereof. The pegs and warp guides may be moved relative to each other. The one or more pegs may remain stationary along their lengths and the one or more weft guides may be rotated about the pegs. The one or more pegs may each include a removable and/or separable weft guide. The one or more pegs may be free of a weft guide. The one or more pegs may include a mechanism to connect a flexible medium to the peg that is not a weft guide. The pegs may be free of rotation. The one or more pegs may pivot, be movable back and forth, or both. The one or more pegs may be moved in an x-direction, a y-direction, a z-direction, or a combination thereof. For example, the one more pegs may be staggered along a longitude of the device and after each warp is placed between the pegs, the pegs may be laterally moved so that the stagger is alternated. The one or more pegs may be tilted. For example, the one or more pegs may extend at an angle other than perpendicular to the device. For example, the pegs may extend at alternating angles with the device such that one peg extends at a and angle of about 5 degrees with a plane and the next peg extends at about a −5 degree angle with a plane and so on along the length of the device. The angle of the pegs may be alternated between each warp flexible medium being applied so that the warp flexible mediums are on alternating sides of the pegs. The one or more pegs may be flexible. The one or more pegs may have a flexible outer shell with a movable center portion on the inside such that upon movement of a bias device the flexible outer shell is bent from side to side. For example, an upper region of the one or more pegs may be bent to extend from a plane (e.g., vertical plane) so that alternating pegs are bent in different directions. The movable center portion may bend in two or more directions from vertical plane, may be substantially all of each peg, may bend only a top of a peg, or a combination thereof. The one or more pegs may be held stationary and the device may be rotated about the pegs (e.g., in a hub and spoke configuration the hub may be rotated and the spokes may remain stationary). The one or more pegs may be in any configuration so that the one or more pegs are used to form an article. The configuration of the pegs may be changed from use to use depending on the desired article. The one or more pegs when placed in the device may be generally linear, form an "S" configuration, form a "C" configuration, an arc, a circle, a spoke off of a hub, or a combination thereof. The one or more pegs may be made of any material so that the pegs function to assist in creating an article. The pegs may be made of a polymer, plastic, steel, metal, a natural material, a synthetic material, the same material as the body portion and/or housing structure, or a combination thereof. Each of the pegs may include one or more warp connectors at any location along their length.

The one or more warp connectors may function to connect a warp flexible medium to the peg, to the loom, so that a warp flexible medium extends along the peg, is connected proximate to the peg. The warp connector may be located only at the top of the peg (e.g., a weft guide). The one or more warp connectors may be located at virtually any location along the peg so that one or more warp flexible mediums are connected to each of the one or more pegs and preferably the plurality of pegs. The warp connectors may be a device that holds the warp flexible mediums taught, holds the warp flexible mediums so that addition of the weft flexible mediums does not pull the warp flexible mediums out of alignment, or a combination thereof. The one or more pegs may include an integral warp connector such as a recess, a hollow portion, a laterally extending piece, one or more recesses for attaching (e.g., knotting, tying, rubber banding, clipping, or a combination thereof) one or more flexible mediums (e.g., one or more warp flexible mediums), or a combination thereof. The one or more warp flexible mediums may extend through a hole to form a connection. The one or more warp flexible mediums may be placed into the peg so that the peg retains the warp flexible mediums taught, proximate to each respective peg, free of movement by a weft flexible medium, or a combination thereof. The one or more warp connectors and preferably a plurality of warp connectors may be located on the pegs, be part of the pegs, be part of the housing structure, located on the housing structure, or a combination thereof. The one or more warp flexible mediums may extend into, wrap around, be gripped by, or a combination thereof each of the one or more warp connectors. The warp connectors may be a clamp, a clip, a recess, a through hole, an elevated piece, a projecting piece, a part that a flexible medium may be wrapped around and/or connected to, or a combination thereof. The one or more warp connectors may be located opposite a rotation device. Each of the one or more pegs and preferably each of a plurality of pegs each include a rotation device at one end and a weft guide at an opposing end. The pegs as discussed herein may include a weft guide or be free of a weft guide. For example, when discussing an angle of the peg, the angle may be created by the weft guide or the angle of the peg itself.

The one or more weft guide may function to guide one or more flexible mediums and preferably one or more weft flexible mediums at least partially around and/or alternatingly around the plurality of pegs. The one or more weft guides may function to hold one or more warp flexible mediums on the top of a peg, may function to attach the one or more warp flexible mediums to each peg, to guide one or more weft flexible mediums around the one or more warp flexible mediums, or a combination thereof. The one or more weft guides may have a static opening so that the one or more flexible mediums when placed in the weft guide are held by friction, tying, gravity, a interference fit, or a combination thereof. The one or more weft guides may include a dynamic opening. The one or more weft guides may open and dose. The one or more weft guides may include a hinge, jaw, or both for moving the weft guide. The one or more weft guides may include a gripping feature. The one or more weft guides may include one or more flexible flaps that retain the flexible medium within the weft guide (e.g., a rubber flap that is biased to allow easy entry and create a force to remove the flexible mediums). The one or more weft guides may include a tacky substance, a substance with an increased friction, an expandable and/or contractible substance, or a combination thereof to retain flexible mediums within the weft guides. The one or more weft guides may be rotated relative to the one or more pegs. For example, the one or more pegs may be stationary and the one or more weft guides may be rotated by a rotation device that extends through the pegs. The one or more weft guides may be removable from each of the pegs so that the flexible mediums may be removed from the pegs, an integral part of the peg, have a removable portion, have a portion that is variable in size or shape, or a combination thereof. Each of the plurality of guides may have a different size or shape along the length of the device, the width of the device, depending on their location within the device, or a combination thereof. The one or more weft guides may have a narrow neck portion. The narrow neck portion may function as an attachment point for one or more flexible mediums. Preferably, the narrow neck portion functions as an attachment point for one or more warp flexible mediums. The one or more weft guides may function to extend at an angle so that the one or more weft flexible mediums are guided to a first side or a second side of each of the one or more pegs based upon the orientation of the one or more weft guides. The one or more weft guides may be an odd weft guide (i.e., a weft guide that faces a first direction) or an even weft guide (i.e., a weft guide that faces in a second direction that opposes the first direction). The one or more weft guides may extend in a first direction and guide the weft flexible mediums on a second side of a peg. The one or more weft guides may extend in a second direction and guide the weft flexible mediums on a first side of a peg. The one or more weft guides may extend at a sufficient angle so that one or more weft flexible mediums are guided on a predetermined side of a peg. The one or more weft guides may extend at an angle relative to the longitudinal axis, the rotational axis, or both of the pegs. The one or more weft guides may extend at an angle of about 5 degrees or more, about 10 degrees or more, about 15 degrees or more, or even about 20 degrees or more with the longitudinal axis, the rotational axis, or both of the pegs. The one or more weft guides may extend at an angle of about 90 degrees or less, about 75 degrees, or less, about 60 degrees or less, or about 45 degrees or less. The one or more weft guides may be rotated between extending in a first direction and extending in a second direction. The one or more weft guides may include a connection feature.

The connection feature may function to receive the one or more flexible mediums, hold the one or more flexible mediums in position along a respective peg, may rotate the one or more flexible mediums with the one or more pegs, or a combination thereof. The connection feature may be located at any location along the pegs. The connection feature may be located in a middle of the pegs, at the bottom of the pegs, in a bottom half of the pegs, in a top half of the pegs, or a combination thereof. Preferably, the connection feature is located at a top of the pegs. The connection feature may include two or more jaw structures with one or more gaps formed therebetween for receiving the one or more flexible mediums. The connection features may function to connect to a flexible medium before weft flexible mediums are looped around the pegs. The connection features may function to connect a flexible medium after the weft flexible mediums are looped around the pegs. For example, the connection featured may be located proximate to a base of the pegs and the housing may include a port that the flexible mediums may be placed through to connect to the connection feature so that when the pegs are removed the pegs move the warp flexible medium through the looped weft flexible mediums so that the weft flexible mediums are located on the warp flexible mediums. The one or more flexible mediums may be looped around one or both of the jaw structures. The one or more flexible mediums may be extended through the gap, hook to the gap, or both. One or more connection holes may be located proximate to one or both of the jaw structures, proximate to the gap, on one or both of the jaw structures, or a combination thereof. The connection hole may be a through hole, a recess, a depression, or a combination thereof. The connection feature may include one or more connection guides.

The connection guides may function to orient the weft guides so that the weft guides are alternatingly arranged along the loom. The connection guides may be configured such that the weft guides can only be installed in one position. The connection guides may be configured so that the weft guides, the pegs, or both can be installed in a plurality of positions (i.e., 2, 3, 4, or more). The connection guides may be any shape so that the weft guides are aligned in a predetermined arrangement. The connection guides may be "D" shaped, symmetrical, asymmetrical, have a geometric shape, square, rectangular, triangular, star shaped, diamond shaped, cross-shaped, align the weft guides away from a centerline, or a combination thereof.

The connection guides may be complementary to an alternating guide that alternates the warp so that the warp fits between the pegs in an alternating fashion. The alternating guide may connect to the warp and be moved so that the warp is alternating and then be placed down the pegs and the warp released so that the warp flexible medium forms an alternating fashion around the pegs. The alternating guide may guide the flexible mediums around each of the pegs. The alternating guide may connect to any medium discussed herein such as a flexible medium.

The device may use one or more pieces of flexible medium. The flexible medium may function to be woven, overlapped, intertwined, or a combination thereof to form an article. The flexible medium may be any medium that may be tied in a knot. The flexible medium may be any color. The flexible medium may be a warp flexible medium (e.g., a flexible medium that is held taught), a weft flexible medium (e.g., a flexible medium that is woven around one or more warp flexible mediums), or both. The warp flexible medium and the weft flexible medium may be the same material, a different material, or a combination thereof. The warp flexible medium and the weft flexible medium may be any material as discussed herein. The flexible medium may be any cross-sectional length (e.g., diameter). The cross sectional length of the flexible medium may vary from flexible medium to flexible medium, from place to place on a flexible medium, or both. Pieces of different size, shape, color, material, diameter, or the like may be used separately or in conjunction with each other. The flexible medium may be yarn, embroidery floss, string, thread, a synthetic textile, a natural textile, a synthetic cord, a natural cord, a plastic cord, rope, a flexible metal, a fabric that includes a flexible metal, strips of fabric, strips of plastic (e.g., grocery bags), paper, ribbon, hemp, a braided material, a woven material, a twisted material, the like, or a combination thereof. Preferably, the flexible medium may be yarn or woven fabric strips. The warp flexible mediums and the weft flexible mediums may be made of different materials. For example, the one or more warp flexible mediums may be made of a more rigid material, a less expensive material, or both than the weft materials. The one or more flexible mediums may be measured before the one or more flexible mediums are attached to the weft guides, interwoven around the pegs, or both. Preferably, at least one of the one or more flexible mediums (e.g., the weft flexible mediums) may not be measured before the one or more flexible mediums are woven around the plurality of pegs. The device may include one or more spooling locations for the flexible mediums.

The device may include one or more weft spools, one or more warp spools, or both for holding excess flexible medium when not in use. The device may include a plurality of warp spools and one weft spool or vice versa. The weft spool, warp spool, or both may function to hold excess flexible mediums, tension the flexible mediums, recoil excess flexible mediums, keep flexible mediums out of the work area, allow for a user to pause during use of the device and restart at a later time, or a combination thereof. The weft spool, warp spool, or both may function to allow a user to create an article of an indefinite length or width at the beginning of the creative process. For example, the user may begin creating an article and at a later time determine when the desired length is achieved. In another example, a warp spool may be located proximate to, at, near, or a combination thereof the base of each peg and the desired amount of warp flexible medium extended from the spool and attached to the weft guide and then tensioned using the warp spool, and if additional warp flexible medium is needed or desired it can be removed from the spool so that an extended length article may be created. The one or more weft spools may be located on a side location and weft flexible medium extended from the spool as desired to wrap around, through, or both the one or more pegs, one or more warp flexible mediums, or both. The weft spools, the warp spools, or both may be located proximate to a finished article take up spool.

A finished product take up spool may function to store and/or hold all or a portion of a finished product. The finished product take up spool may hold a portion of the finished product so that the finished portion may be removed from the pegs and placed out of the work area. The finished product take up spool may function to maintain the integrity of a finished product. The finished product take up spool may allow a user to pause creating an article and resume at a later time without adverse effects to the article. The finished product take up spool may assist in holding the finished product so that an end may be cut, combined together, finalized, or a combination thereof.

The device may include a cutter. The cutter may be any device that will safely cut one or more and preferably a plurality of flexible mediums simultaneously. The cutter may be a slot that the flexible mediums are placed in with a sharp edge so that the flexible mediums are cut. The cutter may be in a location so that a user's finger, hand, clothing or a combination thereof may not fit in the slot and become cut. The cutter may move. The cutter may be stationary. The cutter may include a lock. The lock may be any device such that the user has to open the lock in order to use the cutter. The cutter may require the user to use both hand simultaneously so that the cutter may not injure the user. For example, the flexible mediums are placed in the cutter and the user has to pull a pin with one hand and pull a lever arm down with the other to cut the flexible mediums. The cutter may have a default position of closed so that when not in use the cutter automatically retracts into the device so that the sharp edge is not exposed. The cutter may include a tensioning device so that the flexible mediums are held in tension when they are cut. The cutter may create tension as the cutter is moved (i.e. lowered down unto the flexible mediums). The cutter may be a discrete device that may be connected to the loom so that the loom and cutter are used in tandem.

The device may include a scale to measure the length of the flexible medium or other mediums used with the device (i.e. a length measurement tool). The scale may be a separate part of the device. Preferably, the scale is an integral part of the device. More preferably, a piece of the device includes a scale. For example, the housing structure, the peg housing, the support housing, or a combination thereof may include a scale and/or be the scale. A scale may be molded into a part of the device.

The device as discussed herein may be a kit. The device described herein may be sold in a kit. The device described herein may be included in a kit. The kit may include the device, flexible mediums, secondary mediums, pre-cut mediums, pre-cut flexible mediums, the like or a combination thereof. The secondary mediums may be beads, decorative articles, charms, decorative embellishments made of metal, fabric, textiles, felt, plastic, a polymer, a synthetic material, a natural material, or a combination thereof. The kit may further include replacement parts, charms, clips, pins, hooks, clamps, dowels, instructions (e.g. printed or a DVD), carrying case, carrying handle, detachable rotation devices, loop assist devices, cutting devices, knot tying devices, or a combination thereof. The kit may include one or more instruction booklets, one or more access codes to online tutorials, one or more access codes to online instruction manuals, or a combination thereof. The kit may include one or more weft applicators.

The one or more weft applicators may function to guide a flexible medium around the pegs, the weft guides, or both. The weft applicator may connect to a flexible medium and assist in guiding the flexible medium around each of the pegs, each of the weft guides, or both so that the entire length of the flexible medium is applied simultaneously, without the need for guiding the weft flexible medium, or both. The one or more weft applicators may be substantially straight, serpentine shaped, square, circular, mirror the shape of the device, or a combination thereof. The one or more weft applicators may slide wrap around the flexible medium and slide along the length of the flexible medium once the flexible medium is applied. The one or more weft applicators may be malleable, rigid, include one or more hinges, or a combination thereof. The kit may include one or more peg removal devices.

The one or more removal devices may function to remove all of the pegs, all of the weft guides, or both simultaneously. The one or more removal devices may grip one or more, two or more, half, three-quarters, or a predetermined number of pegs, and/or weft guides, or a combination thereof. The one or more removal devices may remove every other peg, weft guide, or both. The one or more removal devices may assist in removing and re-installing the pegs, the weft guides, or both after the weft flexible medium is placed on the warp flexible medium.

The device as discussed herein may be used in a method. The method may include one or more of the steps recited herein and the steps may be performed in virtually any order. The method may include a step of attaching one or more weft flexible mediums, warp flexible mediums, or both to the one or more weft guides. Connecting one or more pegs to the loom, disconnecting one or more pegs from the loom, or both. The weft flexible medium may be connected before the pegs are installed in the loom, after the pegs are installed in the loom, or both. Connecting one or more weft guides to each peg, disconnecting one or more weft guides from each peg, or both. Connecting one or more flexible mediums to the weft guides, the pegs, or both. Moving the translation mechanism so that the pegs, the weft guides, or both move about an axis, laterally, longitudinally, diagonally, rotationally, bend, angle, or a combination thereof. Moving the translation mechanism so that the pegs, the weft guides, or both move relative to a plane (e.g., a vertical plane) so that a space is formed between the opposing pegs, weft guides, or both. Placing one or more flexible medium between the opposing pegs, weft guides, or both so that the one or more flexible mediums extend around the pegs, weft guides, or both in an alternating fashion. Wrapping the one or more flexible mediums at least partially around the last peg, the last weft guide, or both so that the one or more flexible mediums extend in a second direction. Actuating the translation mechanism so that the pegs, the weft guides, or both are reoriented (e.g., rotated, angled, or both) and so that the one or more flexible mediums may be extended along a second side of the pegs, weft guides, or both. Joining two or more looms together using the male housing attachment site, the female housing attaching site, the male actuation attachment site, the female actuation attachment site, or a combination thereof. Simultaneously, actuating two more looms using a single rotation device. Connecting one or more flexible mediums to one or more connection guides, one or more connection holes, one or more connection features, one or more narrow necks, or a combination thereof.

FIG. 1 illustrates a perspective view of a loom 2 including one or more weft guides 12 affixed to an end of one or more pegs 10. One end of the one or more pegs 10 is disposed in the housing structure 32. The housing structure 32 includes a support housing 34 and a peg housing 36. The housing structure 32 has a male attachment site 50 and male actuation attachment site 54 at one end and a female attachment site 52 at the opposite end. The housing structure 32 induces a bias device 72 that actuates the one or more pegs 10 and one or more weft guides 12. The one or more weft guides 12 curve in a direction and the weft guides 12 face in an alternating relationship.

Figure 2:
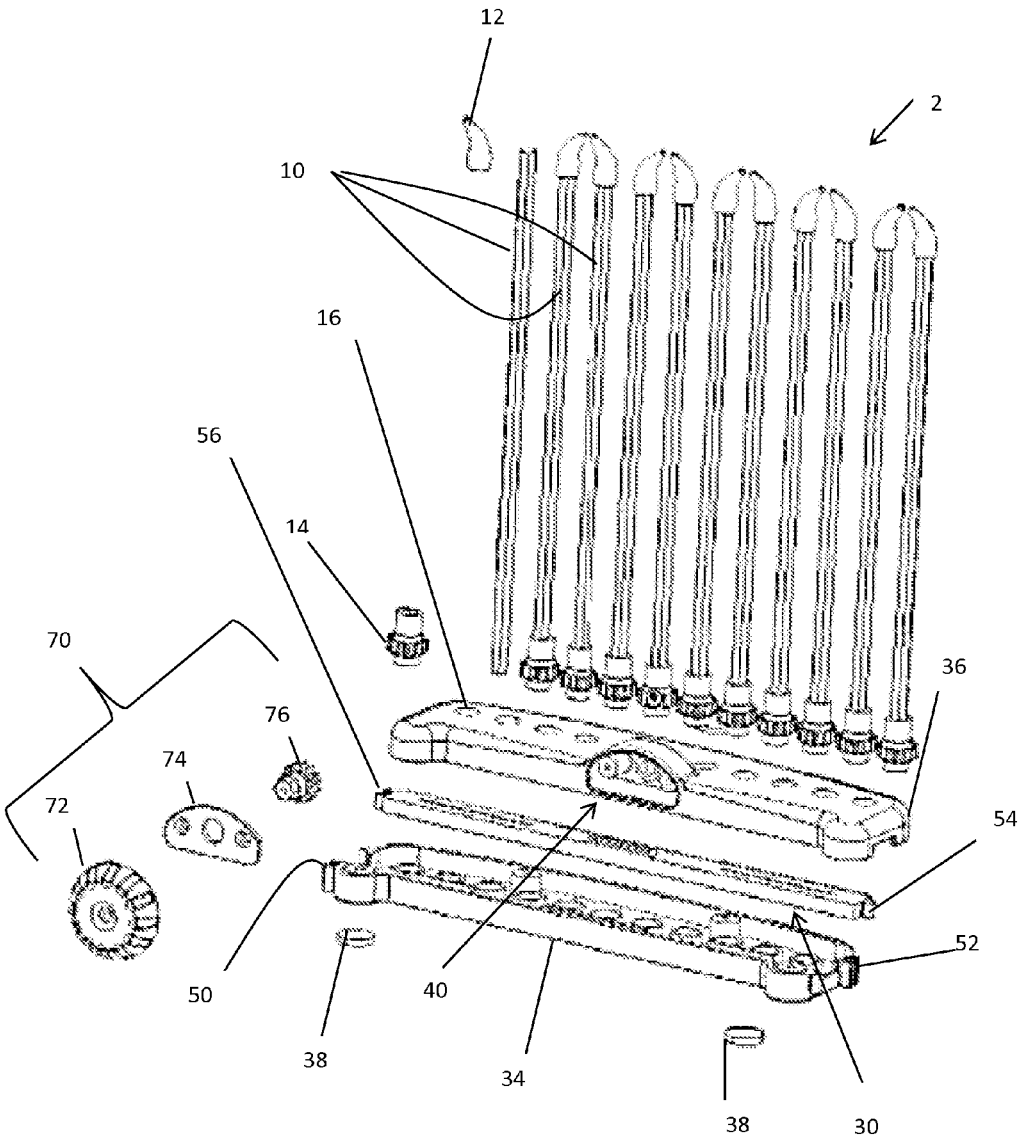
FIG. 2 illustrates an exploded view of the loom.

FIG. 2 illustrates an exploded view of the loom 2 of FIG. 1. The loom 2 includes a plurality of pegs 10 that are each attached to one or more weft guides 12 on one end and one or more rotation devices 14 on an opposing end. The one or more rotation devices 14 are each received in one or more receiving holes 16 in the peg housing 36. The peg housing 36 has a front side and a back side, and the front side has a gear joint 40 located in the central portion on the front side of the peg housing 36. The peg housing 36 and the support housing 34 are secured together to enclose an actuation device 30. The actuation device 30 has a male attachment site 54 at one end and a female actuation attachment site 56 at the opposite end of the male attachment site 54. The support housing 34 has a male housing attachment site 50 on one end, a female housing attachment site 52 on one end, and one or more gripping pads 38 located on the bottom side of the support housing 34 so that the gripping pads 38 maintain the loom 2 static when the translation mechanism 70 is moved. The translation mechanism 70 includes a bias device 72, a guiding device 74, and a translation device 76. The bias device 72 is attached to a guiding device 74 that receives a translation device 76. The translation mechanism 70 fits into and is affixed to the gear joint 40 in the peg housing structure 36.

Figure 3:
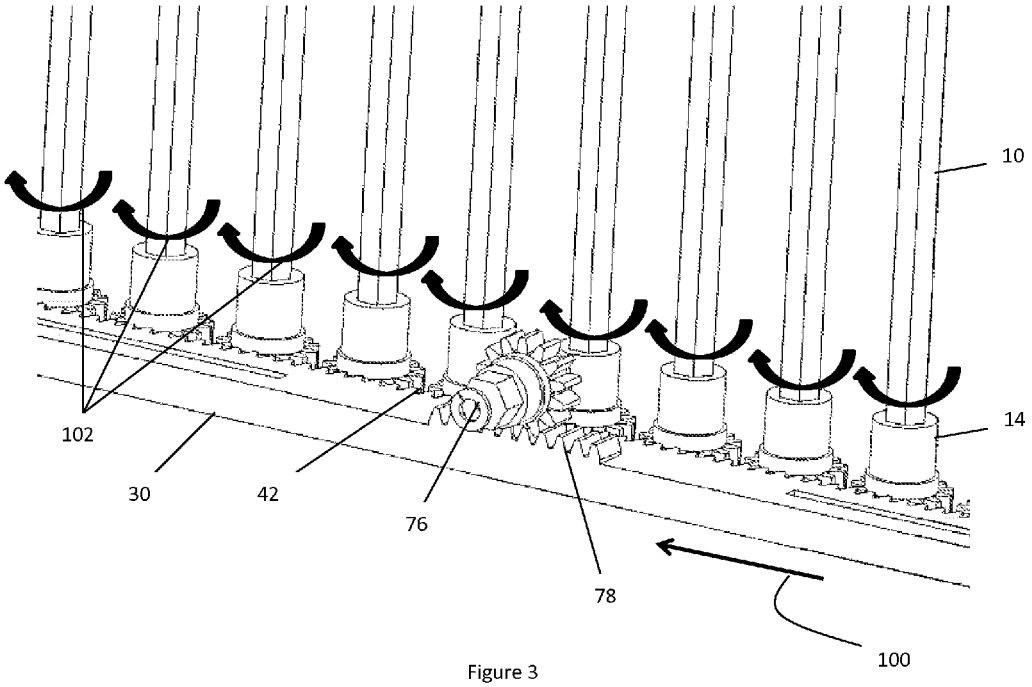
FIG. 3 illustrates a perspective view of some of the movable components of the loom.

FIG. 3 illustrates a magnified view of an actuation device 30. The actuation device includes a translation device 76 that is in communication with the rotation gears 78 so that movement of the translation device 76 causes the actuation device 30 and actuation gear 42 to move in the direction 100. The movement of the actuation device 30 in the direction 100 causes the rotation device 14 to rotate the one or more pegs 10 in the direction 102.

Figure 4:
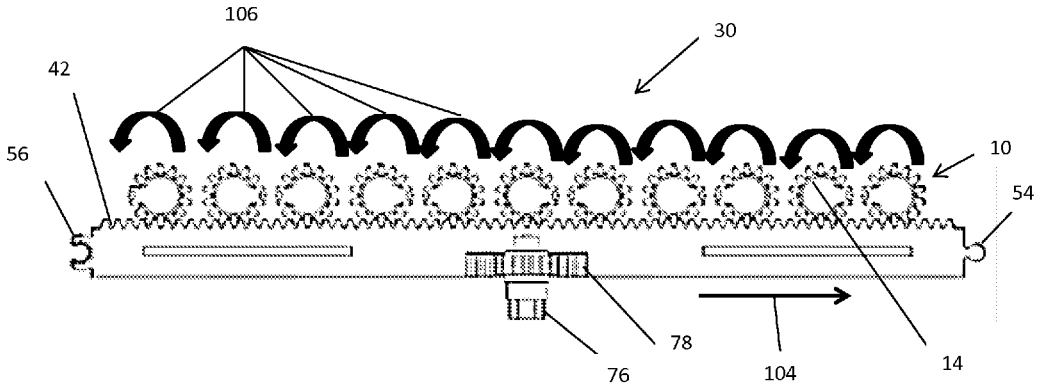
FIG. 4 illustrates a top view of the movable components of the loom.

FIG. 4 illustrates a top view of the actuation device 30. The actuation device 30 includes a translation device 76 that is in communication with the rotation gears 78. The rotation gears 78 are located on the top side of the actuation device 30 so that movement of the translation device 76 moves the actuation device 30 in the direction 104. The actuation device 30 includes actuation gears 42 that are configures along substantially along the length of the actuation device 30, and as the actuation device 30 is moved the actuation gears 42 cause the plurality of rotation devices 14 to rotate the pegs 10 simultaneously about each peg in the direction 106, when the actuation device 30 is moved in the opposing direction the rotation devices 14 are rotated in the opposing direction as is illustrated in FIG. 4. The actuation device 30 includes a male actuation attachment site 54 on one end and a female actuation attachment site 56 on a second end.

Figure 5:
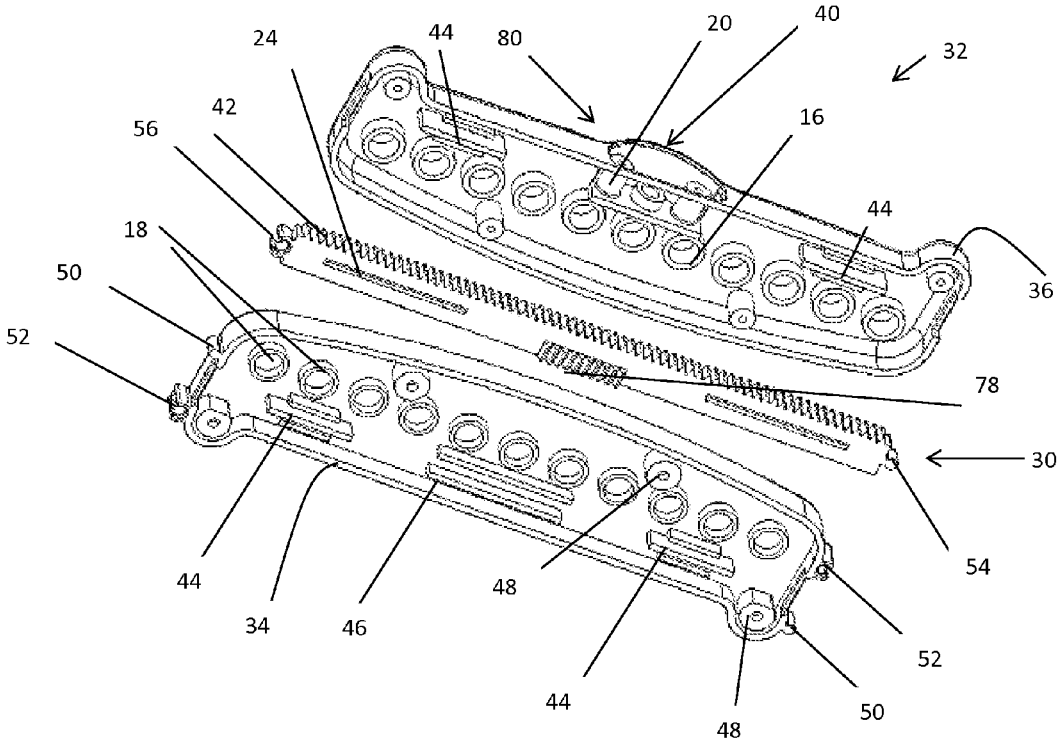
FIG. 5 illustrates an exploded view of a housing structure.

FIG. 5 illustrates an exploded view of the housing structures 32 with the support housing 34 and peg housing 36 rotated so that the inside of the housing structures 32 are shown. The support housing 35 includes male housing attachment sites 50 and female housing attachment sites 52 on both ends. The inside of the support housing 34 includes a plurality of rotation device receiving slots 18 and the inside of the peg housing 36 includes a plurality of rotation device receiving holes 16. The rotation device receiving slots 18 and rotation device receiving holes 16 secure the rotation device 14 (not shown) into position inside the housing structures 32. The housing structure 32 also including a plurality of housing structure attachment points 48 securing the support housing 34 to the peg housing 36. Both of the housing structures 32 have one or more housing structure guide ridges 44 that secure and align the support housing 34 to the peg housing 36 and secure and align the actuation device 30 therebetween via one or more actuation device slots 24 so that movement of the actuation device 30 is along a predetermined path. The peg housing 36 also includes a translation device receiving slot 20 and a guiding device attachment point 80 so that when the translation device 76 connects to the peg housing 36 the translation device 76 is in communication with the rotation gears 78 of the actuation device 30. The actuation device 30 includes a male actuation attachment site 54 at one end and a female actuation attachment site 56 and on opposing end and a rotation gear 78 therebetween. The housing structure 32 has one or more gear joint guiding ridges 46 that secure and align the peg housing 36 with the support housing 34 so that the gear joint 40 is supported and aligned.

Figure 6:
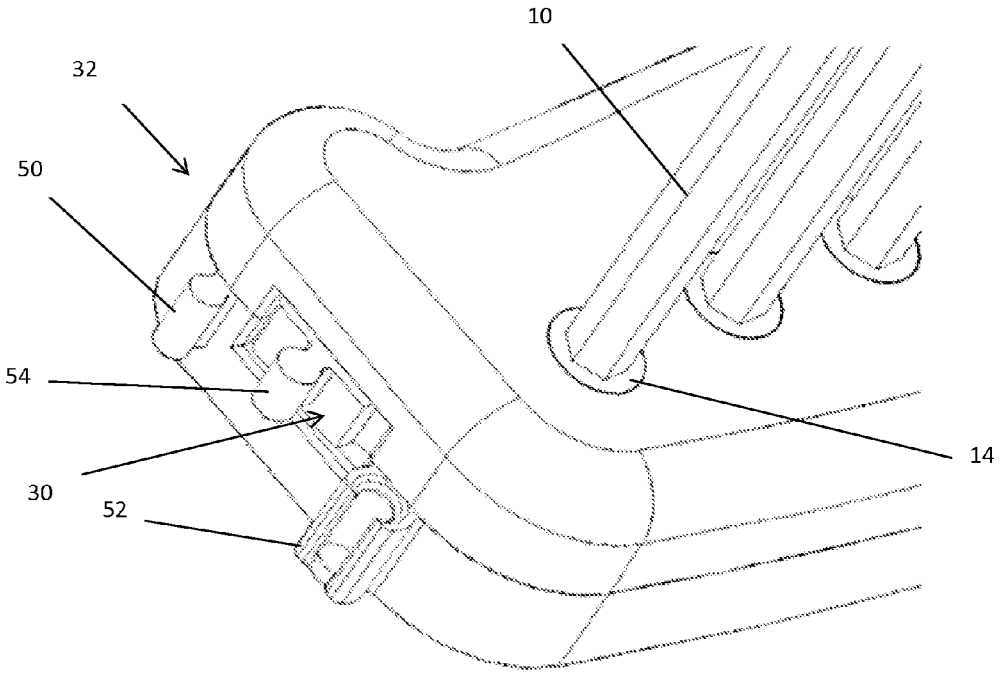
FIG. 6 illustrates a close-up view of one end of a loom.
Figure 7:
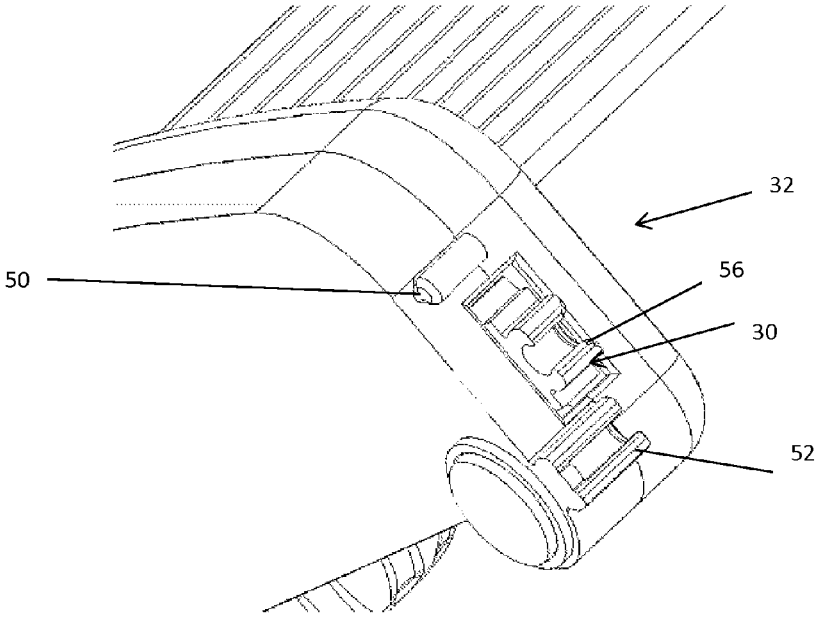
FIG. 7 illustrates a close-up view of an end of a loom.

FIG. 6 illustrates a view of one end of the housing structure 32 of FIG. 1. As illustrated, a plurality of pegs 10 are extending into a rotation device 14 that is disposed within the housing structure 32. The end of the housing structure 32 includes a male housing attachment site 50 towards a front and a female housing attachment site 52 towards a rear of the housing structure 32. An end of the actuation device 30 extends out of the housing structure 32 so that a male actuation attachment site 54 is exposed FIG. 7 illustrates a view of another end of the housing structure 32 of FIG. 1. The end of the housing structure 32 includes a female housing attachment site 52 towards a front side and a male housing attachment site 50 towards a rear side of the housing structure 32. An end of the actuation device 30 extends out of the housing structure 32 so that a female actuation attachment site 56 is exposed.

Figure 8:
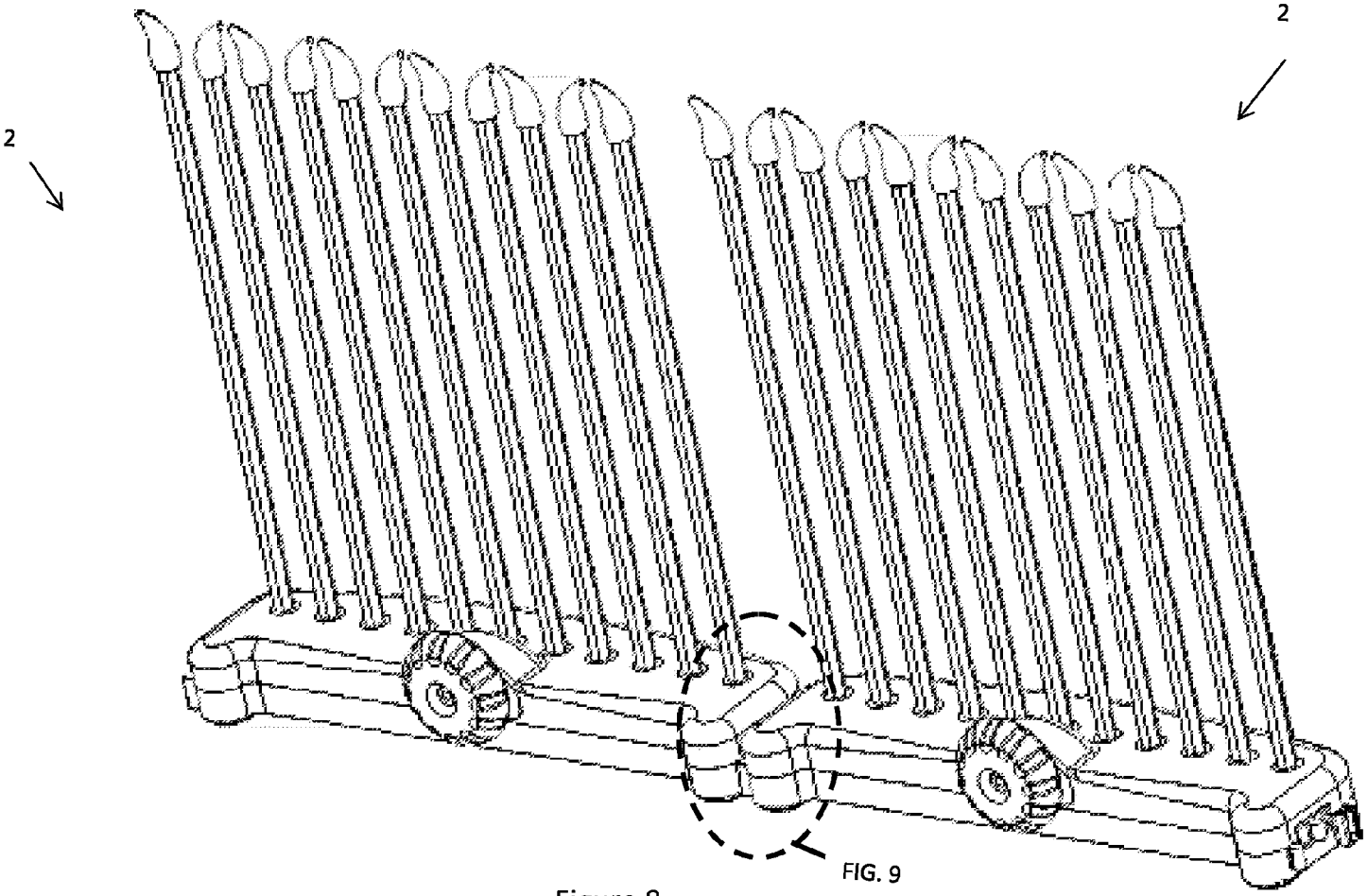
FIG. 8 illustrates a perspective view of two looms connected.

FIG. 8 illustrates a perspective view of two looms 2 connected together so that the looms 2 can be used simultaneously.

Figure 9:
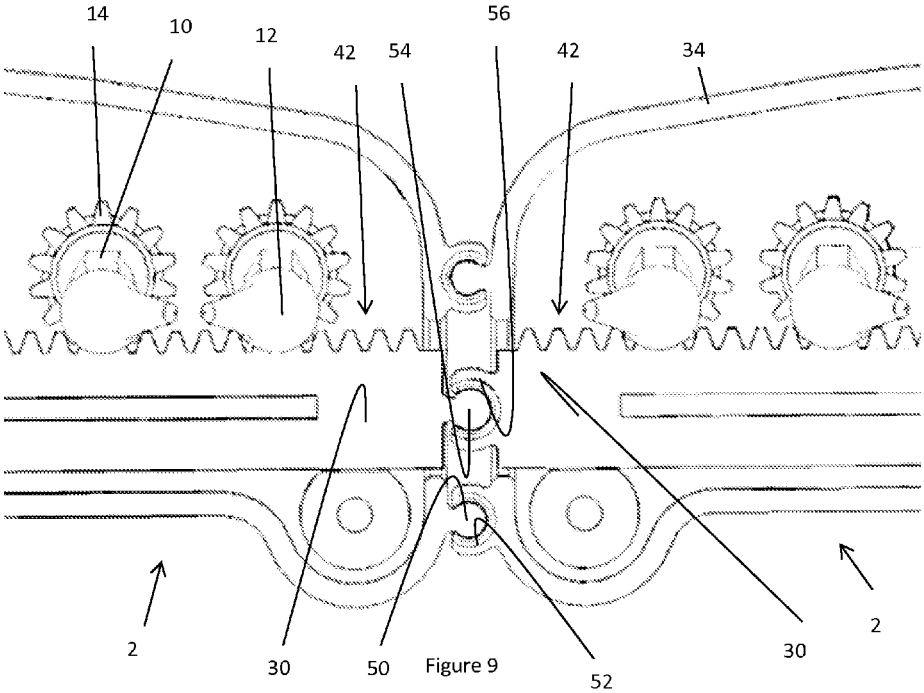
FIG. 9 illustrates a top view two looms connected.

FIG. 9 illustrates a top view of the connection between the two looms 2 with the housing structure removed. The actuation devices 30 of the two adjacent looms 2 are connected via a male actuation attachment site 54 and a female actuation attachment site 56 so that movement of one actuation devices 30 moves the adjacent actuation device 30. As the actuation devices 30 move the actuation gears 42 rotate the plurality of rotation devices 14, the pegs 10, and weft guides 12. The support housing 34 and peg housing 36 each include a male housing attachment site 50 and a female housing attachment site 52.

Figure 10:
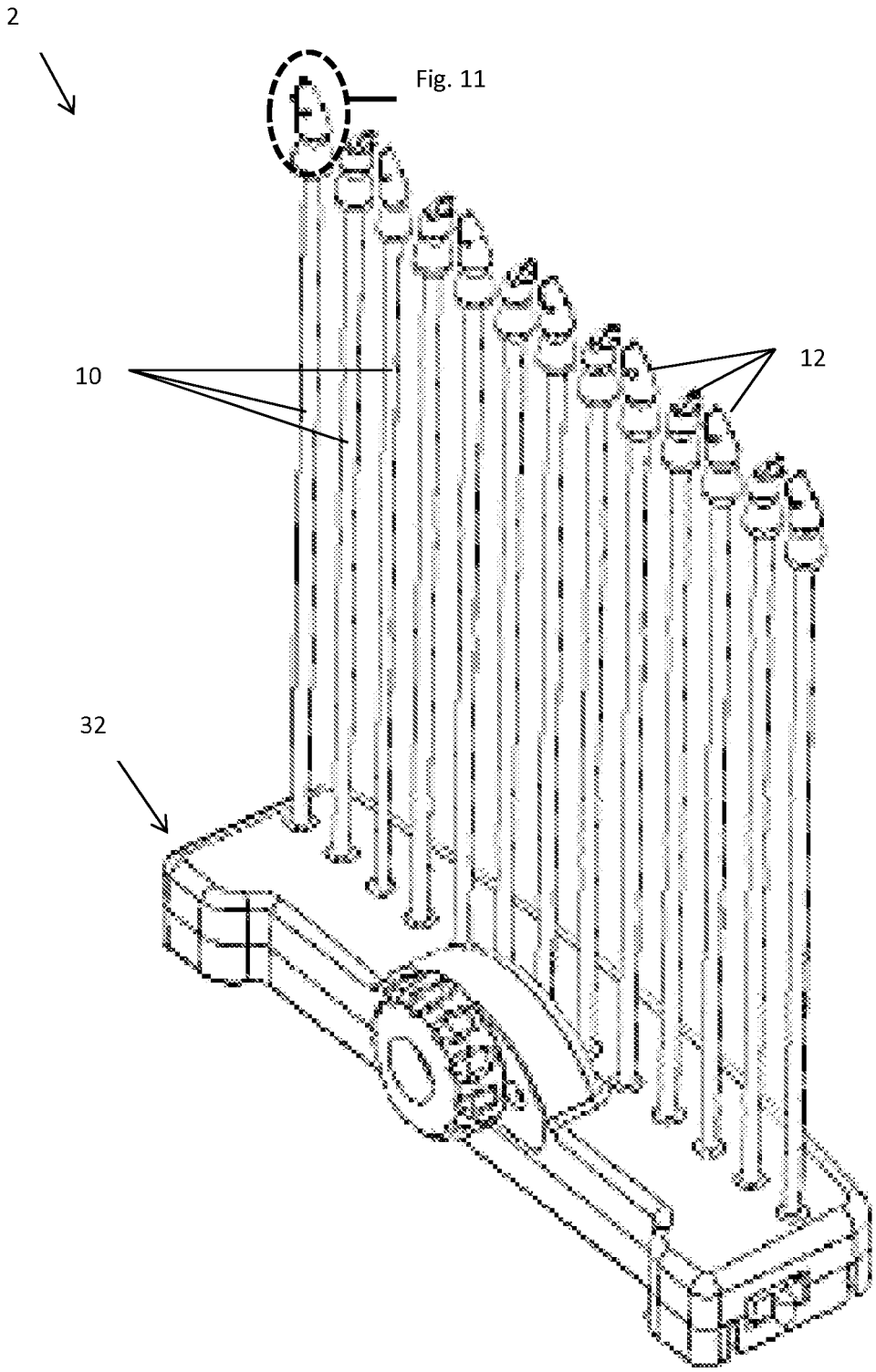
FIG. 10 illustrates a perspective view of another embodiment of a loom.

FIG. 10 illustrates another example of a loom 2. The loom 2 includes a housing structure 32 in communication with a plurality of pegs 10 that each include a weft guide 12. The weft guides 12 face in an alternating fashion so that the weft guides are configured substantially 180 degrees from each other.

Figure 11:
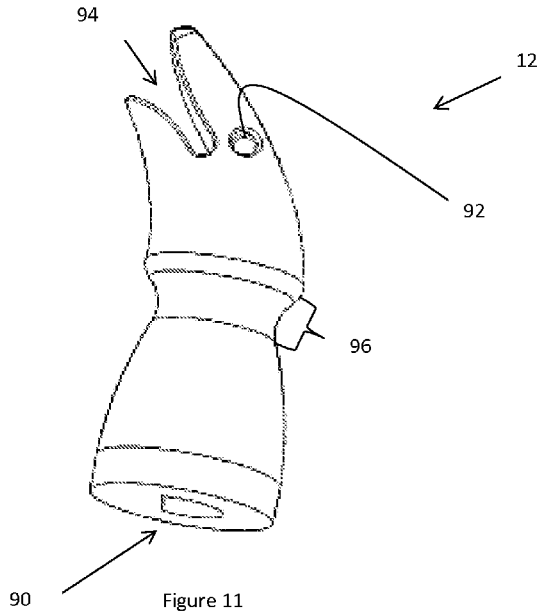
FIG. 11 illustrates a perspective view of a weft guide.

FIG. 11 illustrates a bottom perspective view of an example of a weft guide 12. The weft guide 12 includes a connection guide 90 in a bottom portion and a connection hole 92 and connection feature 94 in an upper portion for receiving and connecting to a flexible medium. The weft guide 12 includes a narrow neck 96 below the connection hole 92 and connection feature 94 so that one or more flexible mediums may be connected at the narrow neck 96 in addition to and/or in place of the connection hole 92 or connection feature 94.

Figure 12:
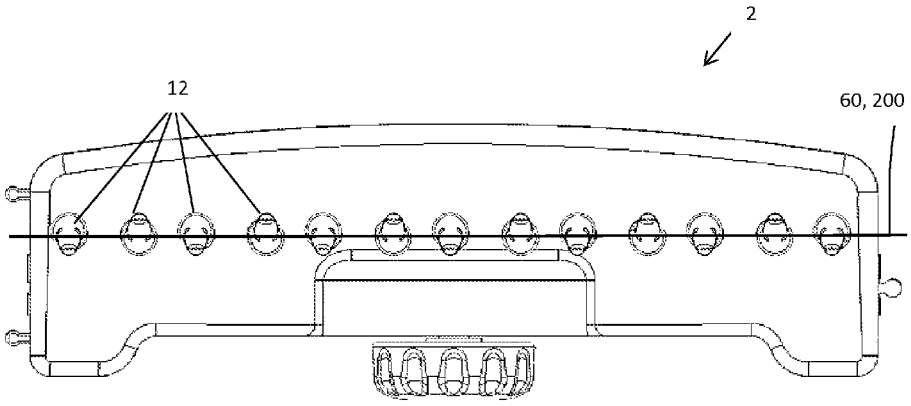
FIG. 12 illustrates a top view of the loom with the weft guides configured to receive a weft.

FIG. 12 illustrates a top view of a loom 2 including a plurality of weft guides 12. The weft guides 12 extend in alternative opposing sides of a vertical plane 200. As illustrated, a weft flexible medium 60 extends along the back of each of the weft guides 12 so that the direction of the weft guide 12 determines the orientation of the weft flexible medium 60 without the user having to guide the weft flexible medium around each individual peg (not shown).

Figure 13:
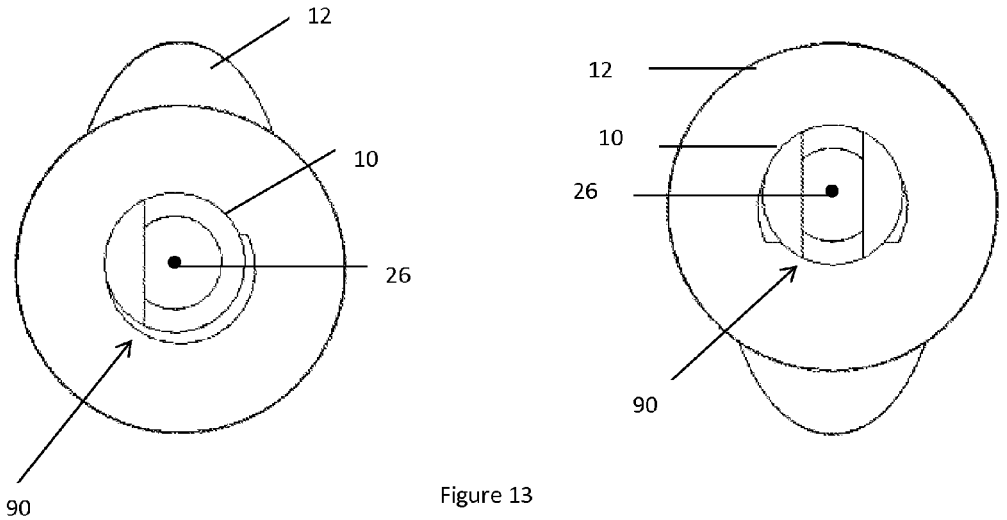
FIG. 13 illustrates a bottom view of the weft guides and their axis of rotation.

FIG. 13 illustrates a bottom view of a pair of weft guides 12. The weft guides 12 are each connected to a peg 10. The peg 10 and weft guide 12 are each rotatable about a respective axis of rotation 26 so that the orientation of the weft guides 12 can be changed after application of weft flexible medium (not shown) and the weft flexible mediums are guided on alternating sides of the pegs 10. The pegs 10 each include a connection guide 90 on the end opposite the weft guides 12 so that the pegs 10 and weft guides 12 will all be aligned when the pegs 10 are inserted in a housing structure (not shown). Weft guides 12 extend on each side of the vertical plane 200 so that some weft guides are on a first side and some weft guides are on a second side of the vertical plane 200.

Figure 14:
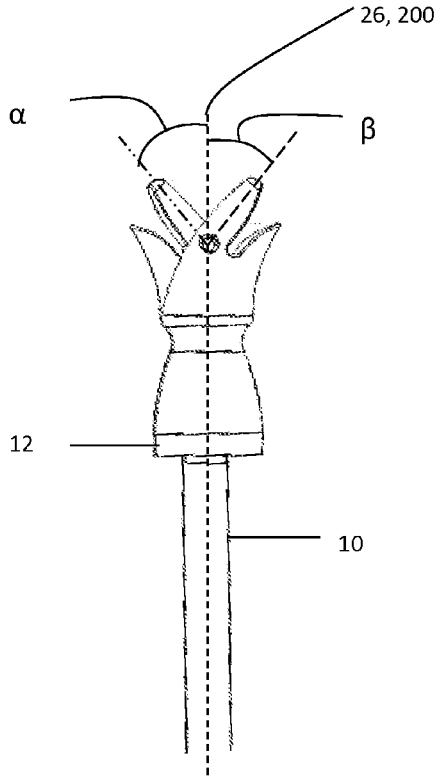
FIG. 14 illustrates a side view of pegs and weft guides.

FIG. 14 illustrates alternating weft guides 12 each connected to a peg 10. As shown, one weft guide 12 extends in a first direction and the opposing weft guide 12 extends in a second direction. Both weft guides 12 have an axis of rotation 26 that extends along the length of the peg 10 and weft guide 12. One weft guide 12 extends at an angle ($\alpha$) away from the axis of rotation 26 and the opposing weft guide 12 extends at an angle ($\beta$) away from the axis of rotation so that a recess is formed between the two weft guides for receiving a weft flexible medium (not shown).

Figure 15:
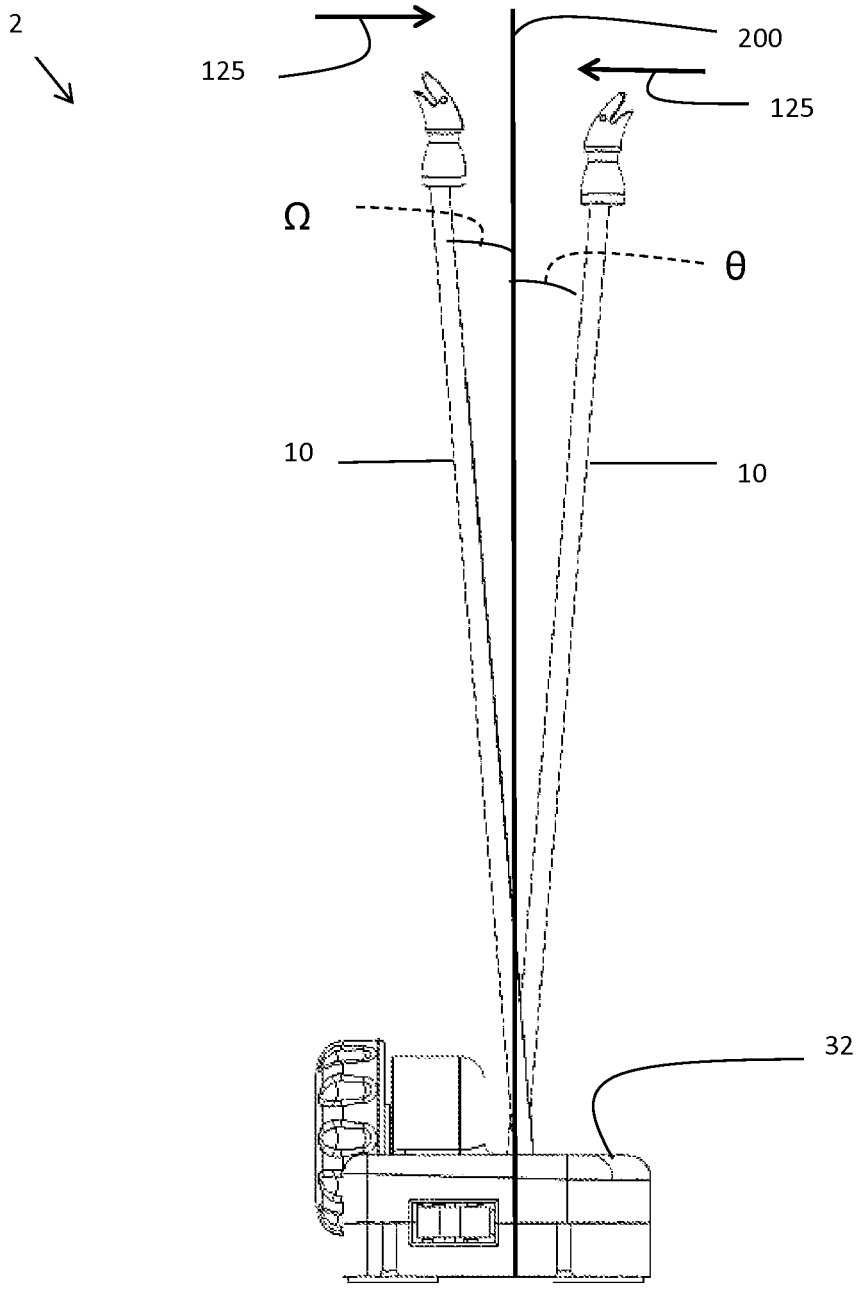
FIG. 15 illustrates and end view of the loom with the pegs tilted.

FIG. 15 illustrates a loom 2 including pegs 10 that are tilted away from the vertical plane 200. The pegs 10 are connected to the housing structure 32 and extend at an angle so that a gap is formed between the opposing pegs 10 for receiving a flexible medium (not shown). The first set of pegs 10 extend at an angle ($\Omega$) from the vertical plane 200 and the second set of pegs 10 extend at an angle ($\theta$) from the vertical plane 200. After a flexible medium is placed between the opposing pegs 10, the pegs 10 are moved in the direction 125 so that the pegs 10 reverse the alternating fashion.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner.

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of or even consists of the elements, ingredients, components or steps.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

I claim:

1. A device comprising: a. a plurality of pegs including a translation mechanism that moves one or more of the plurality of pegs; b. a housing structure; wherein at least a portion of the plurality of pegs extend at an angle relative to a plane so that at least a first portion of the plurality of pegs are on a first side of the plane and at least a second portion of the plurality of pegs are on a second side of the plane, and wherein the at least first portion of the plurality of pegs are moved from the first side of the plane to the second side of the plane and the at least second portion of the plurality of pegs are moved from the second side of the plane to the first side of the plane by the translation mechanism rotating the one or more of the plurality of pegs about a longitudinal axis of each of the one or more of plurality of pegs.

2. The device of claim 1, wherein one or more of the plurality of pegs include a weft guide.

3. The device of claim 1, wherein one or more of the pegs are curved, shaped, configured to curve, or a combination thereof so that the pegs guide a flexible medium along the plane between one or more of the plurality of pegs.

4. The device of claim 1, wherein the housing includes one or more attachment sites so that another device is connected to the device.

5. The device of claim 4, wherein the device and the another device when connected work simultaneously, individually, or a combination of both.

6. The device of claim 2, wherein the plurality of weft guides each include a connection guide that aligns each the plurality of weft guides relative to each of the plurality of pegs, each of the plurality of pegs include a connection guide that aligns each of the plurality of pegs relative to the housing structure, or both.

7. The device of claim 6, wherein the plurality of weft guides are integrally formed with each of the plurality of pegs and the plurality pegs each include the connection guide at a base of the peg and the connection guide is substantially "D" shaped, is unidirectional, or includes an alignment structure so that the plurality of pegs and weft guides can only be connected in a predetermined direction, or a combination thereof.

8. The device of claim 2, wherein the plurality of weft guides each include a connection feature so that one or more pieces of flexible medium are connected to each of the weft guides and extend along a peg.

9. The device of claim 2, wherein each of the plurality of weft guides are removable from each of the plurality of pegs, each of the plurality of pegs are removable from the housing structure, or both.

10. The device of claim 1, wherein each of the plurality of pegs include one or more gears that assist in moving the plurality of pegs about the plane.

11. The device of claim 1, wherein the housing structure includes one or more actuation devices and the one or more actuation devices are in communication with one or more of the plurality of pegs so that movement of the actuation device moves one or more of the plurality of pegs about the plane.

12. The device of claim 1, wherein the plurality of pegs are entirely or partially circular, triangular, rectangular, pentagonal, asymmetrical, symmetrical, a geometric shape, generally "D" shaped, or a combination thereof.

13. The device of claim 1, wherein the device is linear, curved, a circle, a partial circle, is a hub and the plurality of pegs are a spoke that extend from the hub, jointed so that the device can move from a linear shape to an arcuate shape, generally "S" shaped, or a combination thereof.

14. A method comprising:

a. providing a device including:

a housing structure which houses a plurality of pegs including a translation mechanism that moves one or more of the plurality of pegs, said plurality of pegs each include a portion that extend at an angle relative to a plane so that at least a first portion of one or more of the plurality of pegs on a first side of the plane and at least a second portion of one or more of the plurality of pegs are on a second side of the plane;

b. extending one or more weft mediums substantially along the plane so that the one or more weft mediums are located on a first side of one or more of the plurality of pegs and on a second side of one or more of the plurality of pegs; and c. moving the plurality of pegs about a longitudinal axis of at least one of the plurality of pegs by the translation mechanism so that at least one of the plurality pegs on the first side of the plane moves to the second side of the plane or so that at least one of the plurality of pegs on the second side of the plane moves to the first side of the plane.

15. The method of claim 14, wherein the steps of moving one or more of the plurality of pegs from the first side of the plane to the second side of the plane are repeated a plurality of times until a desired article is created.

16. The method of claim 15, wherein the one or more weft mediums are extending along the plane after each movement of the pegs from a first side to a second side or vice versa and once a predetermined amount of flexible medium is located on each of the plurality of pegs, the one or more woven weft mediums are freed from the pegs unto a warp flexible medium.

17. The method of claim 16, wherein the steps of moving the plurality of pegs from a first side to a second side and vice versa, the one or more weft flexible mediums are extended along the plane, and freeing the woven weft flexible mediums from the plurality of pegs are repeated a plurality of times until an article of a desired size is created, and wherein one or more of the warp flexible mediums, one or more of the weft flexible mediums or both are secured so that the article is fixed together.

* * * * *